US010488771B2

(12) United States Patent
Mori et al.

(10) Patent No.: US 10,488,771 B2
(45) Date of Patent: Nov. 26, 2019

(54) ELECTROPHOTOGRAPHIC PHOTOSENSITIVE MEMBER, METHOD FOR PRODUCING THE SAME, PROCESS CARTRIDGE, AND ELECTROPHOTOGRAPHIC APPARATUS

(71) Applicant: CANON KABUSHIKI KAISHA, Tokyo (JP)

(72) Inventors: Haruki Mori, Ichikawa (JP); Masaki Nonaka, Toride (JP); Koichi Nakata, Tokyo (JP); Shinji Takagi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/136,828

(22) Filed: Sep. 20, 2018

(65) Prior Publication Data

US 2019/0094726 A1 Mar. 28, 2019

(30) Foreign Application Priority Data

Sep. 27, 2017 (JP) ..... 2017-186624

(51) Int. Cl.

| | |
|---|---|
| ***G03G 5/147*** | (2006.01) |
| ***G03G 5/06*** | (2006.01) |
| ***G03G 5/05*** | (2006.01) |
| ***G03G 5/07*** | (2006.01) |

(52) U.S. Cl.

CPC ..... *G03G 5/14786* (2013.01); *G03G 5/0542* (2013.01); *G03G 5/0546* (2013.01); *G03G 5/0609* (2013.01); *G03G 5/0614* (2013.01); *G03G 5/071* (2013.01); *G03G 5/14734* (2013.01); *G03G 5/14795* (2013.01); *G03G 2221/1869* (2013.01)

(58) Field of Classification Search

CPC ..... G03G 5/14786; G03G 5/14734; G03G 5/071; G03G 5/0546; G03G 5/0589; G03G 5/0542

USPC ..... 430/58.7

See application file for complete search history.

(56) References Cited

U.S. PATENT DOCUMENTS

| | | | | |
|---|---|---|---|---|
| 7,226,711 | B2 | 1/2007 | Amamiya et al. | |
| 7,186,489 | B2 | 3/2007 | Uematsu et al. | |
| 7,333,752 | B2 | 2/2008 | Kawahara et al. | |
| 7,534,534 | B2 | 5/2009 | Nakata et al. | |
| 7,732,113 | B2 | 6/2010 | Nakamura et al. | |
| 7,910,274 | B2 | 3/2011 | Tanaka et al. | |
| 8,088,541 | B2 | 1/2012 | Tanaka et al. | |
| 8,343,699 | B2 | 1/2013 | Nagasaka et al. | |
| 8,415,078 | B2 | 4/2013 | Tanaka et al. | |
| 8,465,889 | B2 | 6/2013 | Sekido et al. | |
| 8,524,430 | B2 | 9/2013 | Takagi et al. | |
| 8,524,433 | B2 * | 9/2013 | Doi | G03G 21/18 430/56 |
| 8,546,050 | B2 | 10/2013 | Maruyama et al. | |
| 8,632,931 | B2 | 1/2014 | Sekido et al. | |
| 8,783,209 | B2 | 7/2014 | Kaku et al. | |
| 8,795,936 | B2 | 8/2014 | Sekido et al. | |
| 9,244,369 | B2 | 1/2016 | Tanaka et al. | |
| 9,316,931 | B2 | 4/2016 | Takagi et al. | |
| 9,389,523 | B2 | 7/2016 | Nakata et al. | |
| 9,594,318 | B2 | 3/2017 | Nakata et al. | |
| 9,740,117 | B2 | 8/2017 | Kosaka et al. | |
| 10,042,272 | B2 | 8/2018 | Mori et al. | |
| 2017/0315458 | A1 * | 11/2017 | Takagi | G03G 21/1814 |

FOREIGN PATENT DOCUMENTS

| | | | |
|---|---|---|---|
| JP | 2000-66425 | A | 3/2000 |
| JP | 2006-178351 | A | 7/2006 |
| JP | 2016-90593 | A | 5/2016 |

OTHER PUBLICATIONS

Diamond, A.S., ed. Handbook of Imaging Materials, Marcel Dekker, Inc., NY (1991), pp. 395-396 (Year: 1991).*
U.S. Appl. No. 15/614,695, Koichi Nakata, filed Jun. 6, 2017.
U.S. Appl. No. 15/969,836, Haruki Mori, filed May 3, 2018.
U.S. Appl. No. 15/980,806, Koichi Nakata, filed May 16, 2018.
U.S. Appl. No. 16/002,421, Koichi Nakata, filed Jun. 7, 2018.
U.S. Appl. No. 16/053,905, Ryoichi Tokimitsu, filed Aug. 3, 2018.
U.S. Appl. No. 16/101,575, Koichi Nakata, filed Aug. 13, 2018.

* cited by examiner

*Primary Examiner* — Janis L Dote
(74) *Attorney, Agent, or Firm* — Venable LLP

(57) ABSTRACT

A surface layer of an electrophotographic photosensitive member contains a cured product of a composition containing a hole transport compound having an acryloyloxy group or a methacryloyloxy group, and a compound having a specific structure.

9 Claims, 4 Drawing Sheets

ELECTROPHOTOGRAPHIC PHOTOSENSITIVE MEMBER, METHOD FOR PRODUCING THE SAME, PROCESS CARTRIDGE, AND ELECTROPHOTOGRAPHIC APPARATUS

BACKGROUND OF THE INVENTION

Field of the Invention

The present invention relates to an electrophotographic photosensitive member, a method for producing the electrophotographic photosensitive member, and a process cartridge and an electrophotographic apparatus each having the electrophotographic photosensitive member.

Description of the Related Art

As the electrophotographic photosensitive member mounted on an electrophotographic apparatus, there is an organic electrophotographic photosensitive member (hereinafter, referred to as "electrophotographic photosensitive member") containing an organic photoconductive material (charge generating material), and a wide range of studies have been conducted so far. In recent years, it is required to improve the durability of the electrophotographic photosensitive member, and a technique for containing a cured product obtained by polymerizing a compound that has a chain polymerizable functional group in a surface layer of the electrophotographic photosensitive member has been known (Japanese Patent Application Laid-Open No. 2000-66425 and Japanese Patent Application Laid-Open No. 2006-178351).

In the electrophotographic photosensitive member using such a technique, there has been a problem in the image quality in repeated use while the durability has improved. In particular, a streaky image defect (image streaks) caused by lack of the lubricity on a surface of the electrophotographic photosensitive member has been a problem. Therefore, recently, a technique for improving the material, physical properties and the like on a surface of the electrophotographic photosensitive member have been studied. In Japanese Patent Application Laid-Open No. 2016-90593, there is a description of an electrophotographic photosensitive member containing a compound having a long-chain alkyl group on the surface layer, and in such an electrophotographic photosensitive member, the image streaks caused by deterioration of the lubricity on a surface of the electrophotographic photosensitive member in repeated use have been suppressed.

However, according to the studies of the present inventors, in the electrophotographic photosensitive member described in Japanese Patent Application Laid-Open No. 2016-90593, changes in image density due to the fluctuations in electrical potential were generated in repeated use. Therefore, in such an electrophotographic photosensitive member, there has been a problem to exhibit stable and favorable electric characteristics from the initial stage of use to the repeated use.

SUMMARY OF THE INVENTION

An object of the present invention is to provide an electrophotographic photosensitive member that suppresses image streaks in repeated use and exhibits favorable electric characteristics, and a method for producing the electrophotographic photosensitive member. In addition, an object of the present invention is also to provide a process cartridge and an electrophotographic apparatus each having the electrophotographic photosensitive member.

The above-described object is achieved according to the following present invention. That is, an electrophotographic photosensitive member according to an embodiment of the present invention includes: a support; a photosensitive layer; and a surface layer in this order, the surface layer of the electrophotographic photosensitive member being a cured product of a composition containing a hole transport compound having an acryloyloxy group or a methacryloyloxy group, and a compound represented by the following formula (1):

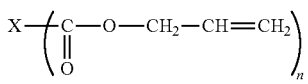

(1)

wherein n is an integer of 1 or more, and X is an n-valent group obtained by removing n pieces of hydrogen atoms from either an alkane having 7 or more carbon atoms or a compound having 7 or more carbon atoms represented by the following formula (2):

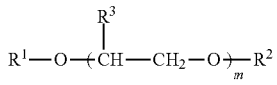

(2)

wherein m is an integer of 0 or more, $R^1$ and $R^2$ each represent an alkyl group, $R^3$ represents a hydrogen atom or a methyl group, and $R^1$ and $R^2$ may be the same as or different from each other.

In addition, the method for producing the electrophotographic photosensitive member according to the present invention is a method for producing an electrophotographic photosensitive member having a support, a photosensitive layer, and a surface layer in this order, and the production method is characterized by including a step of preparing a coating liquid for a surface layer containing a hole transport compound having an acryloyloxy group or a methacryloyloxy group and a compound represented by the following formula (1); a step of forming a coating film of the coating liquid for a surface layer; and a step of forming a surface layer of the electrophotographic photosensitive member by curing the coating film.

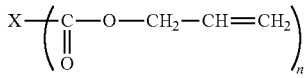

(1)

In the formula (1), n is an integer of 1 or more, and X is an n-valent group obtained by removing n pieces of hydrogen atoms from either an alkane having 7 or more carbon atoms or a compound having 7 or more carbon atoms represented by the following formula (2):

(2)

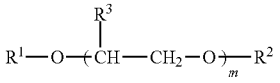

wherein m is an integer of 0 or more, $R^1$ and $R^2$ each represent an alkyl group, $R^3$ represents a hydrogen atom or a methyl group, and $R^1$ and $R^2$ may be the same as or different from each other.

Further, the process cartridge according to the present invention is characterized by integrally supporting the electrophotographic photosensitive member and at least one unit selected from the group consisting of a charging unit, a developing unit, a transferring unit and a cleaning unit, and being detachably attachable to a main body of an electrophotographic apparatus.

In addition, the electrophotographic apparatus according to the present invention is characterized by including an electrophotographic photosensitive member, and a charging unit, an exposing unit, a developing unit and a transferring unit.

Further features of the present invention will become apparent from the following description of exemplary embodiments with reference to the attached drawings.

DESCRIPTION OF THE EMBODIMENTS

Figure 1:
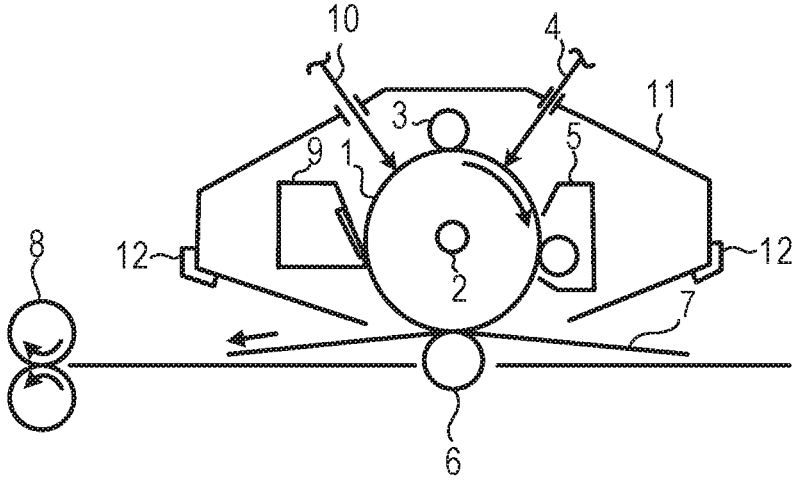
FIG. 1 is a view illustrating an example of a schematic configuration of an electrophotographic apparatus that is provided with a process cartridge having the electrophotographic photosensitive member according to the present invention.

Hereinafter, the present invention will be described in detail by way of suitable embodiments.

The electrophotographic photosensitive member according to the present invention is an electrophotographic photosensitive member having a support, a photosensitive layer, and a surface layer in this order, and is characterized in that the surface layer is a cured product of a composition containing a hole transport compound having an acryloyloxy group or a methacryloyloxy group, and a compound represented by the following formula (1).

(1)

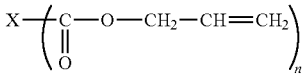

In the formula (1), n is an integer of 1 or more, and X is an n-valent group obtained by removing n pieces of hydrogen atoms from either an alkane having 7 or more carbon atoms or a compound having 7 or more carbon atoms represented by the following formula (2).

(2)

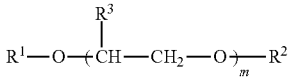

In the formula (2), m is an integer of 0 or more. $R^1$ and $R^2$ each represent an alkyl group, and $R^3$ represents a hydrogen atom or a methyl group. Further, $R^1$ and $R^2$ may be the same as or different from each other.

The present inventors presume the reason why the effect of the present invention is exerted due to having the characteristics described above, as follows.

It is presumed that the image streaks generated in repeated use of the electrophotographic photosensitive member are caused by unstable behavior of a cleaning unit (cleaning blade or the like) due to the fusion of a substance or the like constituting a developer onto a surface of the electrophotographic photosensitive member. In the electrophotographic photosensitive member described in Japanese Patent Application Laid-Open No. 2000-66425 and Japanese Patent Application Laid-Open No. 2006-178351, it is presumed that the image streaks are generated due to the reason described above.

In the electrophotographic photosensitive member described in Japanese Patent Application Laid-Open No. 2016-90593, a (meth)acrylate compound having an alkyl group (long-chain alkyl group) having 8 or more and 19 or less carbon atoms is contained in a surface layer of the electrophotographic photosensitive member. It is considered that the lubricity on a surface of the electrophotographic photosensitive member is improved due to the influence of the long-chain alkyl group, the behavior of a cleaning unit is stabilized, and the generation of image streaks is suppressed.

In addition, this compound has an acryloyloxy group or methacryloyloxy group having chain polymerizability. Therefore, it is considered that a (meth)acrylate compound having a long-chain alkyl group is incorporated to the extent of the crosslinking structure constituting the surface layer, and can be present to the extent of the inside in the depth direction in the surface layer, so that the generation of image streaks can be sufficiently suppressed even in repeated use.

On the other hand, in the electrophotographic photosensitive member described in Japanese Patent Application Laid-Open No. 2016-90593, changes in image density due to the fluctuations in electrical potential were generated in repeated use. It is presumed that the fluctuations in electrical potential in repeated use are caused by the accumulation of electric charge inside the surface layer. It is considered that in a surface layer of the electrophotographic photosensitive member, a polymer in which (meth)acrylate compounds each having a long-chain alkyl group are polymerized with each other is contained. It is presumed that since this polymer does not have a hole transport property, the accumulation of electric charge inside the surface layer is caused.

In contrast, a compound represented by the above-described formula (1), which is adopted in the invention of the present application, has a saturated hydrocarbon moiety having 7 or more carbon atoms. Therefore, the lubricity on a surface of the electrophotographic photosensitive member is improved, and the generation of image streaks can be suppressed. In addition, a compound represented by the above-described formula (1) has an allyl ester group having chain polymerizability. Therefore, it is considered that the compound is incorporated into the crosslinking structure constituting a surface layer, and can be present to the extent of the inside in a depth direction in the surface layer, so that the generation of image streaks can be sufficiently suppressed even in repeated use without completely scraping off the compound by a cleaning unit.

In addition, the allyl ester group exhibits a specific polymerizability in a case of being copolymerized with an acryloyloxy group and a methacryloyloxy group. Specifically, allyl ester groups are hardly reacted with each other, and dominantly reacted with an acryloyloxy group and a methacryloyloxy group. Therefore, in a surface layer of the electrophotographic photosensitive member of the invention of the present application, a polymer obtained by polymerizing the compounds each represented by the above-described formula (1) with each other is hardly contained, and the accumulation of electric charge inside the surface layer is not caused, so that the fluctuations in electrical potential in repeated use can be suppressed.

As in the mechanism described above, the effects of the present invention can be achieved by synergistically exerting effects of the respective constitutions.

X of the compound represented by the above-described formula (1) is an n-valent group obtained by removing n pieces of hydrogen atoms from either an alkane having 7 or more carbon atoms or a compound represented by the above-described formula (2) having 7 or more carbon atoms. When the number of carbon atoms in X is 7 or more, the lubricity on a surface of the electrophotographic photosensitive member is improved, and the generation of image streaks can be suppressed. Preferably, X is an n-valent group obtained by removing n pieces of hydrogen atoms from either an alkane having 7 or more and 19 or less carbon atoms or a compound having 7 or more and 19 or less carbon atoms represented by the above-described formula (2). More preferably, X is an n-valent group obtained by removing n pieces of hydrogen atoms from either an alkane having 9 or more and 14 or less carbon atoms or a compound having 9 or more and 14 or less carbon atoms represented by the above-described formula (2). In this case, more favorable electric characteristics can be obtained.

In the compound represented by the above-described formula (1), n represents the number of allyl ester groups contained in the compound. Preferably, n is 1 or 2. More preferably, n is 1. In this case, more favorable electric characteristics can be obtained.

The content of the compound represented by the above-described formula (1) is preferably 5% by mass or more and 40% by mass or less relative to the mass of the hole transport compound having the above-described acryloyloxy group or methacryloyloxy group.

Hereinafter, specific examples (exemplary compound) of the compound represented by the above-described formula (1) can be mentioned, but the present invention is not limited thereto.

(No.1)

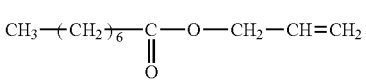

(No.2)

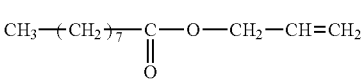

(No.3)

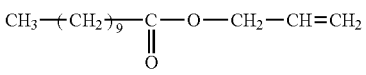

(No.4)

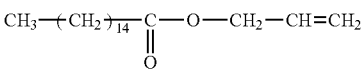

(No.5)

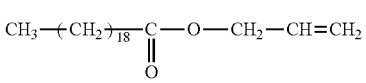

(No.6)

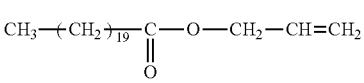

(No.7)

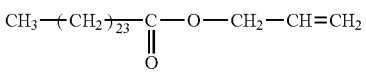

(No.8)

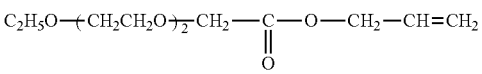

(No.9)

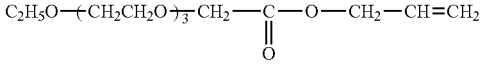

(No.10)

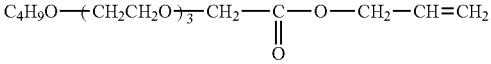

(No.11)

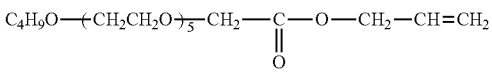

(No.12)

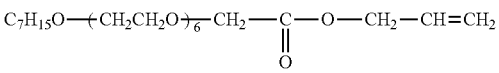

(No.13)

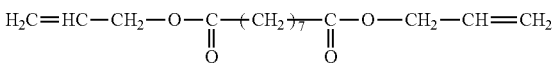

(No.14)

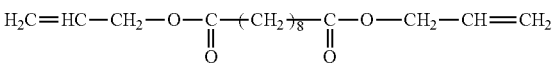

(No.15)

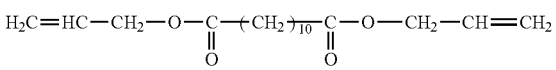

(No.16)

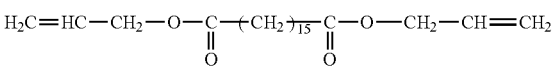

-continued (No.17)

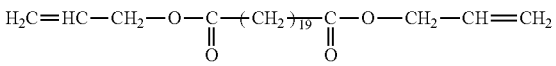

(No.18)

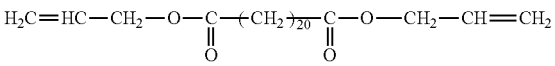

(No.19)

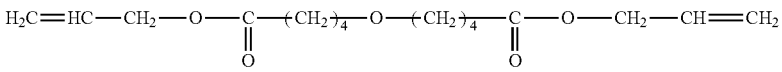

(No.20)

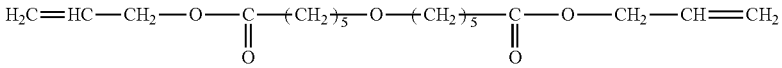

(No.21)

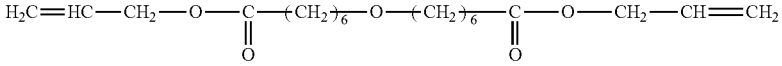

(No.22)

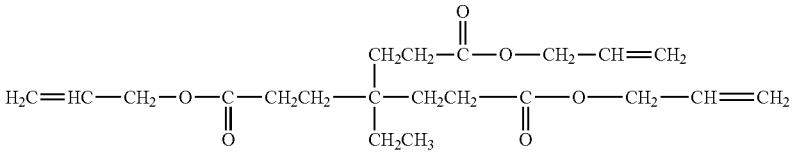

The hole transport compound having the above-described acryloyloxy group or methacryloyloxy group, which constitutes a copolymer with the compound represented by the above-described formula (1), is preferably a compound represented by the following formula (3). In this case, more favorable electric characteristics can be obtained.

$$(P^1)_a A \quad (3)$$

In the formula (3), A represents a hole transport group. $P^1$ is an acryloyloxy group or a methacryloyloxy group. The a is an integer of 2 to 4. Further, $P^1$s may be the same as or different from each other. The hydrogen adduct in which the bonding site of A with $P^1$ is replaced with a hydrogen atom is represented by the following formula (4) or the following formula (5).

(4)

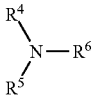

In the formula (4), $R^4$, $R^5$ and $R^6$ each represent a phenyl group that may have an alkyl group having 1 to 6 carbon atoms as a substituent. Further, $R^4$, $R^5$ and $R^6$ may be the same as or different from one another.

(5)

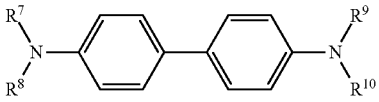

In the formula (5), $R^7$, $R^8$, $R^9$ and $R^{10}$ each represent a phenyl group that may have an alkyl group having 1 to 6 carbon atoms as a substituent. Further, $R^7$, $R^8$, $R^9$ and $R^{10}$ may be the same as or different from one another.

The above-described composition preferably contains a hole transport compound having the above-described acryloyloxy group or methacryloyloxy group, a compound represented by the above-described formula (1), and a siloxane-modified acrylic compound. In this way, the lubricity on a surface of the electrophotographic photosensitive member is improved, and a more favorable suppressive effect on image streaks can be obtained. The siloxane-modified acrylic compound is a compound in which siloxane is introduced as a side chain to an acrylic polymer, and can be obtained by copolymerizing, for example, an acrylic monomer and a siloxane having an acrylic group. As the siloxane-modified acrylic compound available on the market, BYK-3550 manufactured by BYK Japan KK, or the like can be mentioned. The content of the siloxane-modified acrylic compound is preferably 0.5% by mass or more and 5% by mass or less relative to the total mass of the hole transport compound having the above-described acryloyloxy group or methacryloyloxy group and the compound represented by the above-described formula (1).

In addition, in the surface layer, an additive agent such as an antioxidant, a UV absorber, a plasticizer, a leveling agent, a lubricity imparting agent, and an abrasion resistance improver may be contained. Specific examples of the additive agent include a hindered phenol compound, a hindered amine compound, a sulfur compound, a phosphorus compound, a benzophenone compound, a siloxane-modified resin, a silicone oil, fluorine resin particle, polystyrene resin particles, polyethylene resin particles, silica particles, alumina particles, and boron nitride particles.

The average film thickness of the surface layer is preferably 0.5 μm or more and 10 μm or less. Further, the average film thickness of the surface layer is more preferably 1 μm or more and 7 μm or less.

The surface layer can be formed through the following steps: a step of preparing a coating liquid for a surface layer containing a hole transport compound having an acryloyloxy group or a methacryloyloxy group and a compound represented by the above-described formula (1); a step of forming a coating film of the coating liquid for a surface layer; and a step of curing the coating film.

As the solvent used for preparing a coating liquid for a surface layer, a solvent that does not dissolve the layer arranged under the surface layer is preferably used. More preferably, an alcoholic solvent such as methanol, ethanol, propanol, isopropanol, 1-butanol, 2-butanol, and 1-methoxy-2-propanol is used.

Examples of the coating method for forming a coating film of a coating liquid for a surface layer include dip coating, spray coating, inkjet coating, roll coating, die coating, blade coating, curtain coating, wire bar coating, and ring coating. Among these coatings, dip coating is preferred from the viewpoint of the efficiency and the productivity.

As the method for curing a coating film of a coating liquid for a surface layer, a method for curing with heat, UV rays, or electron beams can be mentioned. In order to maintain the strength of the surface layer and the durability of the electrophotographic photosensitive member, the coating film is preferably cured with UV rays or electron beams.

When polymerized using electron beams, an extremely dense (high-density) cured product (three-dimensional crosslinking structure) is obtained, and a surface layer having higher durability is obtained, and therefore this is preferred. In a case where the irradiation is performed with electron beams, examples of the type of an accelerator include a scanning type, an electrocurtain type, a broad beam type, a pulse type, and a laminar type.

In a case where the electron beams are used, from the viewpoint of suppressing the deterioration of material characteristics due to the electron beams without impairing the polymerization efficiency, the acceleration voltage of electron beams is preferably 120 kV or less. Further, the electron beam absorbed dose on a surface of a coating film of a coating liquid for a surface layer is preferably 1 kGy or more and 50 kGy or less, and more preferably 5 kGy or more and 10 kGy or less.

In addition, in a case of curing (polymerizing) the coating film by using electron beams, it is preferred to irradiate the coating film with electron beams under an atmosphere of inert gas, and then to heat the coating film under an atmosphere of inert gas for the purpose of suppressing the polymerization inhibitory action by oxygen. Examples of the inert gas include nitrogen, argon, and helium.

In addition, it is preferred that the electrophotographic photosensitive member is heated to 100° C. or more and 170° C. or less, and then the electrophotographic photosensitive member is irradiated with UV rays or electron beams. In this way, a surface layer that has higher durability and suppresses image defects is obtained.

Next, the constitution of the electrophotographic photosensitive member according to the present invention will be described. Further, each constitution of the electrophotographic photosensitive members will be described, and further the production method of the electrophotographic photosensitive member will also be described.

[Electrophotographic Photosensitive Member]

The electrophotographic photosensitive member according to the present invention is characterized by having a support, a photosensitive layer, and a surface layer (protection layer) in this order.

Figure 2:
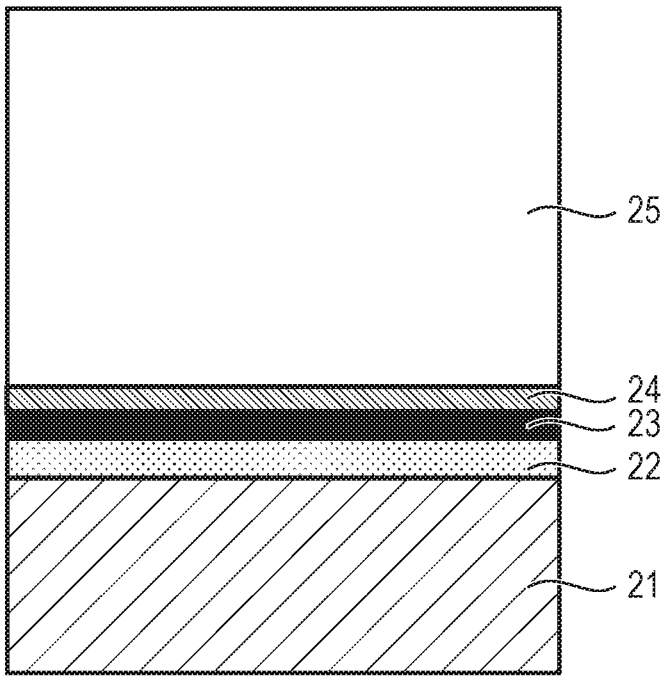
FIG. 2 is a diagram for describing an example of a layer constitution of the electrophotographic photosensitive member according to the present invention.

FIG. 2 is a diagram illustrating an example of a layer constitution of the electrophotographic photosensitive member. In FIG. 2, the electrophotographic photosensitive member has a support 21, an undercoat layer 22, a charge generating layer 23, a charge transport layer 24, and a protection layer 25. In this case, the charge generating layer 23 and the charge transport layer 24 constitute a photosensitive layer, and the protection layer 25 is a surface layer.

As the method for producing the electrophotographic photosensitive member according to the present invention, a method in which a coating liquid for each of layers described later is prepared, applied in the order of desired layer, and dried can be mentioned. As the coating method at this time, the coating methods described above can be mentioned, and from the viewpoint of the efficiency and the productivity, dip coating is preferred.

Hereinafter, a support and each of the layers will be described.

<Support>

In the present invention, the electrophotographic photosensitive member has a support. In the present invention, the support is preferably a conductive support having conductivity. Further, examples of the shape of the support include a cylindrical shape, a belt shape, and a sheet shape. Among them, a support in a cylindrical shape is preferred. In addition, the surface of a support may be subjected to electrochemical treatment such as anodic oxidation, blast treatment, cutting treatment or the like.

As the material for a support, a metal, a resin, a glass or the like is preferred.

Examples of the metal include aluminum, iron, nickel, copper, gold, stainless steel, and an alloy thereof. Among them, a support made of aluminum using aluminum is preferred.

Further, conductivity may be imparted to a resin or a glass by treatment such as mixing or coating of a conductive material.

<Conductive Layer>

In the present invention, a conductive layer may be arranged on a support. By arranging a conductive layer, flaws or irregularities on a surface of a support can be hidden, or reflection of light on a surface of a support can be controlled.

The conductive layer preferably contains conductive particles and a resin.

Examples of the material for conductive particles include a metal oxide, a metal, and a carbon black.

Examples of the metal oxide include a zinc oxide, an aluminum oxide, an indium oxide, a silicon oxide, a zirconium oxide, a tin oxide, a titanium oxide, a magnesium oxide, an antimony oxide, and a bismuth oxide. Examples of the metal include aluminum, nickel, iron, nichrome, copper, zinc, and silver.

Among them, as the material for conductive particles, a metal oxide is preferably used, and in particular, a titanium oxide, a tin oxide, or a zinc oxide is more preferably used.

In a case where a metal oxide is used as the material for conductive particles, the surface of the metal oxide may be treated with a silane coupling agent, or the metal oxide may be doped with an element such as phosphorus or aluminum, or an oxide thereof.

Further, the conductive particles may have a lamination structure having core material particles and a coating layer coating the particles. Examples of the material for core material particles include a titanium oxide, a barium sulfate, and a zinc oxide. As the coating layer, a metal oxide such as a tin oxide can be mentioned.

In addition, in a case where a metal oxide is used as the material for conductive particles, the volume average particle diameter is preferably 1 nm or more and 500 nm or less, and more preferably 3 nm or more and 400 nm or less.

Examples of the resin include a polyester resin, a polycarbonate resin, a polyvinylacetal resin, an acrylic resin, a silicone resin, an epoxy resin, a melamine resin, a polyurethane resin, a phenol resin, and an alkyd resin.

Further, the conductive layer may further contain a masking agent of a silicone oil, resin particles, a titanium oxide, or the like.

The average film thickness of the conductive layer is preferably 1 μm or more and 50 μm or less, and particularly preferably 3 μm or more and 40 μm or less.

The conductive layer can be formed by preparing a coating liquid for a conductive layer, which contains each of the materials described above and a solvent, forming a coating film of the coating liquid, and drying the coating film. Examples of the solvent used for the coating liquid include an alcoholic solvent, a sulfoxide-based solvent, a ketone-based solvent, an ether-based solvent, an ester-based solvent, and an aromatic hydrocarbon-based solvent. As the dispersion method for dispersing conductive particles in a coating liquid for a conductive layer, a method using a paint shaker, a sand mill, a ball mill, or a liquid collision-type high speed disperser can be mentioned.

<Undercoat Layer>

In the present invention, an undercoat layer may be arranged on a support or a conductive layer. By arranging an undercoat layer, the adhesion function between layers is enhanced, and a charge injection blocking function can be imparted.

The undercoat layer preferably contains a resin. Further, the undercoat layer may be formed as a cured film by polymerizing a composition that contains a monomer having a polymerizable functional group.

Examples of the resin include a polyester resin, a polycarbonate resin, a polyvinylacetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamideimide resin, and a cellulose resin.

Examples of the polymerizable functional group of a monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, for the purpose of enhancing the electric characteristics, the undercoat layer may further contain an electron transport substance, a metal oxide, a metal, a conductive polymer, or the like. Among them, an electron transport substance and a metal oxide are preferably used.

Examples of the electron transport substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. By using an electron transport substance having a polymerizable functional group as the electron transport substance, and by copolymerizing with a monomer having the polymerizable functional group described above, the undercoat layer may be formed as a cured film.

Examples of the metal oxide include an indium tin oxide, a tin oxide, an indium oxide, a titanium oxide, a zinc oxide, an aluminum oxide, and a silicon dioxide. Examples of the metal include gold, silver, and aluminum.

In addition, the undercoat layer may further contain an additive agent.

The average film thickness of the undercoat layer is preferably 0.1 μm or more and 50 μm or less, more preferably 0.2 μm or more and 40 μm or less, and particularly preferably 0.3 μm or more and 30 μm or less.

The undercoat layer can be formed by preparing a coating liquid for an undercoat layer, which contains each of the materials described above and a solvent, forming a coating film of the coating liquid, and drying and/or curing the coating film. Examples of the solvent used for the coating liquid include an alcoholic solvent, a ketone-based solvent, an ether-based solvent, an ester-based solvent, and an aromatic hydrocarbon-based solvent.

<Photosensitive Layer>

The photosensitive layer of the electrophotographic photosensitive member is mainly classified into a laminate type photosensitive layer (1), and a monolayer type photosensitive layer (2). The laminate type photosensitive layer (1) has a charge generating layer containing a charge generating material, and a charge transport layer containing a charge transport material. The monolayer type photosensitive layer (2) is a photosensitive layer containing both of a charge generating material and a charge transport material.

(1) Laminate Type Photosensitive Layer

The laminate type photosensitive layer has a charge generating layer and a charge transport layer.

(1-1) Charge Generating Layer

The charge generating layer preferably contains a charge generating material and a resin.

Examples of the charge generating material include an azo pigment, a perylene pigment, a polycyclic quinone pigment, an indigo pigment, and a phthalocyanine pigment. Among them, an azo pigment, and a phthalocyanine pigment are preferred. Among the phthalocyanine pigments, an oxytitanium phthalocyanine pigment, a chlorogallium phthalocyanine pigment, and a hydroxygallium phthalocyanine pigment are preferred.

With respect to the total mass of the charge generating layer, the content of the charge generating material in the charge generating layer is preferably 40% by mass or more and 85% by mass or less, and more preferably 60% by mass or more and 80% by mass or less.

Examples of the resin include a polyester resin, a polycarbonate resin, a polyvinylacetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Among them, a polyvinyl butyral resin is more preferred.

In addition, the charge generating layer may further contain an additive agent such as an antioxidant, and a UV absorber. Specific examples of the additive agent include a hindered phenol compound, a hindered amine compound, a sulfur compound, a phosphorus compound, and a benzophenone compound.

The average film thickness of the charge generating layer is preferably 0.1 μm or more and 1 μm or less, and more preferably 0.15 μm or more and 0.4 μm or less.

The charge generating layer can be formed by preparing a coating liquid for a charge generating layer, which contains each of the materials described above and a solvent, forming a coating film of the coating liquid, and drying the coating film. Examples of the solvent used for the coating liquid include an alcoholic solvent, a sulfoxide-based solvent, a ketone-based solvent, an ether-based solvent, an ester-based solvent, and an aromatic hydrocarbon-based solvent.

(1-2) Charge Transport Layer

The charge transport layer preferably contains a charge transport material, and a resin.

Examples of the charge transport material include a polycyclic aromatic compound, a heterocyclic compound, a hydrazone compound, a styryl compound, an enamine compound, a benzidine compound, a triarylamine compound, and a resin having a group derived from these compounds. Among them, a triarylamine compound, and a benzidine compound are preferred.

With respect to the total mass of the charge transport layer, the content of the charge transport material in the charge transport layer is preferably 25% by mass or more and 70% by mass or less, and more preferably 30% by mass or more and 55% by mass or less.

Examples of the resin include a polyester resin, a polycarbonate resin, an acrylic resin, and a polystyrene resin. Among them, a polycarbonate resin, and a polyester resin are preferred. As the polyester resin, in particular, a polyarylate resin is preferred.

The content ratio (mass ratio) of the charge transport material to the resin is preferably 4:10 to 20:10, and more preferably 5:10 to 12:10.

In addition, the charge transport layer may contain an additive agent such as an antioxidant, a UV absorber, a plasticizer, a leveling agent, a lubricity imparting agent, and an abrasion resistance improver. Specific examples of the additive agent include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average film thickness of the charge transport layer is preferably 5 μm or more and 50 μm or less, more preferably 8 μm or more and 40 μm or less, and particularly preferably 10 μm or more and 30 μm or less.

The charge transport layer can be formed by preparing a coating liquid for a charge transport layer, which contains each of the materials described above and a solvent, forming a coating film of the coating liquid, and drying the coating film. Examples of the solvent used for the coating liquid include an alcoholic solvent, a ketone-based solvent, an ether-based solvent, an ester-based solvent, and an aromatic hydrocarbon-based solvent. Among these solvents, an ether-based solvent, or an aromatic hydrocarbon-based solvent is preferred.

(2) Monolayer Type Photosensitive Layer

The monolayer type photosensitive layer can be formed by preparing a coating liquid for a photosensitive layer, which contains a charge generating material, a charge transport material, a resin and a solvent, forming a coating film of the coating liquid, and drying the coating film. The charge generating material, the charge transport material, and the resin are respectively ones similar to those mentioned as the materials in the above-described "(1) Laminate type photosensitive layer".

<Surface>

The protection layer that is a surface layer can be formed through a step of preparing a coating liquid for a surface layer, a step of forming a coating film of the coating liquid for a surface layer on a photosensitive layer, and a step of forming a surface layer by curing the coating film, as described above.

[Method for Forming a Concave Shape Part on Surface of Electrophotographic Photosensitive Member]

For the purpose of further stabilizing the behavior of a cleaning blade to be brought into contact with the electrophotographic photosensitive member, a concave shape part or a convex shape part is more preferably arranged in a surface layer of the electrophotographic photosensitive member.

The concave shape part or the convex part may be formed over the entire surface of the electrophotographic photosensitive, or may be formed on part of the surface of the electrophotographic photosensitive member. In a case where the concave shape part or the convex shape part is formed on part of the surface of the electrophotographic photosensitive member, the concave shape part or the convex shape part is preferably formed over the entire area at least of contact with the cleaning blade.

In a case where the concave shape part is formed, the concave shape part can be formed by pressing a mold having a convex part corresponding to the concave shape part to be formed, and transferring the shape.

Figure 3:
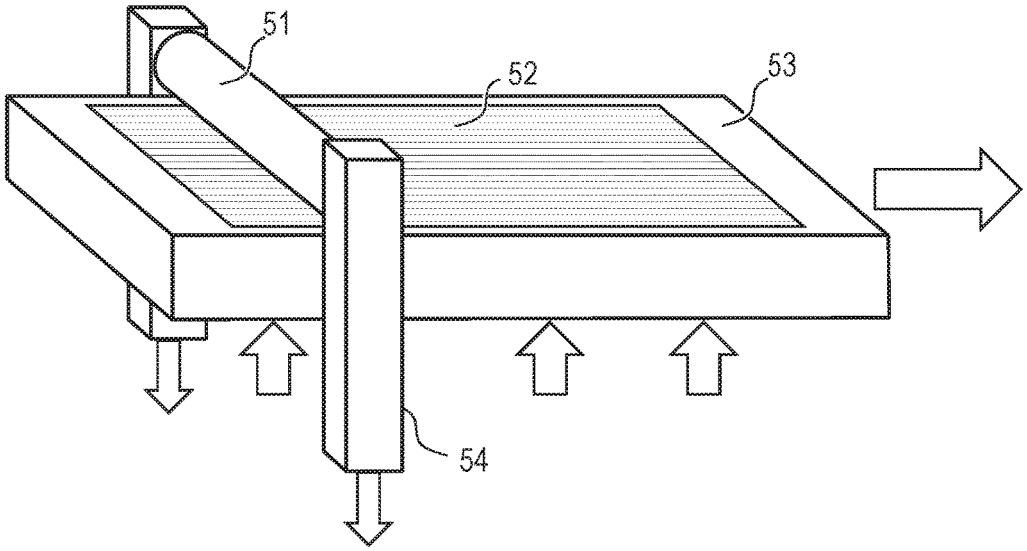
FIG. 3 is a view illustrating an example of a pressure pattern transferring apparatus for forming a concave shape part on a surface of the electrophotographic photosensitive member according to the present invention.

FIG. 3 shows an example of a pressure pattern transferring apparatus for forming a concave shape part on a surface of the electrophotographic photosensitive member.

According to a pressure pattern transferring apparatus illustrated in FIG. 3, by continuously bringing a mold 52 into contact with a surface (circumferential surface) of an electrophotographic photosensitive member 51 that is a workpiece and by pressurizing the contact surface, while rotating the electrophotographic photosensitive member 51, a concave shape part or a plateau can be formed on the surface of the electrophotographic photosensitive member 51.

Examples of the material for a pressure member 53 include a metal, a metal oxide, a plastic, and a glass. Among them, from the viewpoint of the mechanical strength, the dimensional accuracy, and the durability, a stainless steel (SUS) is preferred. On the upper surface of the pressure member 53, a mold 52 is arranged. Further, by a support member (not illustrated) and a pressure system (not illustrated), which have been arranged on the lower surface side, the mold 52 can be brought into contact at a predetermined pressure with a surface of the electrophotographic photosensitive member 51 supported by a support member 54. In addition, the support member 54 may be pressed against the pressure member 53 at a predetermined pressure, or the support member 54 and the pressure member 53 may be pressed against each other.

The example illustrated in FIG. 3 is an example in which by moving the pressure member 53 in a direction perpendicular to the shaft direction of the electrophotographic photosensitive member 51, the surface of the electrophotographic photosensitive member 51 is continuously processed while following or being driven to rotate. Further, by fixing the pressure member 53 and moving the support member 54 in a direction perpendicular to the shaft direction of the electrophotographic photosensitive member 51, or by moving both of the support member 54 and the pressure member 53, the surface of the electrophotographic photosensitive member 51 can also be continuously processed.

In addition, from the viewpoint of efficiently transferring the shape, the mold 52 and the electrophotographic photosensitive member 51 are preferably heated.

As the mold 52, for example, the following ones can be mentioned: one obtained by patterning with a resist on a surface of a finely surface-treated metal, resin film, silicon wafer, or the like; and one obtained by performing metal coating on a resin film in which fine particles have been dispersed or a resin film having a fine surface shape.

In addition, from the viewpoint of setting the pressure of pressing against the electrophotographic photosensitive member 51 to be uniform, an elastic body is preferably arranged between the mold 52 and the pressure member 53.

[Process Cartridge, and Electrophotographic Apparatus]

The process cartridge according to the present invention is characterized by integrally supporting the electrophotographic photosensitive member that has been described so far, and at least one unit selected from the group consisting of a charging unit, a developing unit, a transferring unit and a cleaning unit, and by being detachably attachable to a main body of the electrophotographic apparatus.

In addition, the electrophotographic apparatus according to the present invention is characterized by having the electrophotographic photosensitive member that has been described so far, and a charging unit, an exposing unit, a developing unit and a transferring unit.

FIG. 1 shows an example of a schematic configuration of an electrophotographic apparatus that has a process cartridge provided with an electrophotographic photosensitive member.

The reference numeral 1 denotes an electrophotographic photosensitive member in a cylindrical shape, and which is rotationally driven at a predetermined peripheral speed in a direction of an arrow around a shaft 2. The surface of the electrophotographic photosensitive member 1 is charged to a predetermined positive or negative potential by a charging unit 3. In this regard, in FIG. 1, a roller charging system by a roller-type charging member is illustrated, but a charging system such as a corona charging system, a proximity charging system, an injection charging system or the like may be adopted. The surface of the charged electrophotographic photosensitive member 1 is irradiated with exposure light 4 from an exposing unit (not illustrated), and an electrostatic latent image corresponding to the desired image information is formed. The electrostatic latent image formed on a surface of the electrophotographic photosensitive member 1 is developed with a toner contained in a developing unit 5, and a toner image is formed on a surface of the electrophotographic photosensitive member 1. The toner image formed on a surface of the electrophotographic photosensitive member 1 is transferred to a transfer material 7 by a transferring unit 6. The transfer material 7 to which the toner image has been transferred is conveyed to a fixing unit 8, subjected to fixing processing of the toner image, and printed out to the outside of the electrophotographic apparatus. The electrophotographic apparatus may have a cleaning unit 9 for removing an adhered substance such as a toner remaining on a surface of the electrophotographic photosensitive member 1 after the transfer. Further, a so-called cleanerless system in which a cleaning unit is not separately arranged and the adhered substance is removed by a developing unit or the like may be used. The electrophotographic apparatus may have an antistatic mechanism in which the surface of the electrophotographic photosensitive member 1 is discharged by pre-exposure light 10 from a pre-exposure unit (not illustrated). In addition, in order to attach/detach the process cartridge 11 according to the present invention to/from the main body of the electrophotographic apparatus, a guide unit 12 such as a rail may also be arranged.

The electrophotographic photosensitive member according to the present invention can be used for a laser beam printer, a light-emitting diode (LED) printer, a copying machine, a facsimile machine, a multifunction machine thereof, or the like.

According to the present invention, an electrophotographic photosensitive member that suppresses image streaks in repeated use and exhibits favorable electric characteristics, and a method for producing the electrophotographic photosensitive member are provided. In addition, according to the present invention, a process cartridge and an electrophotographic apparatus each having the electrophotographic photosensitive member are provided.

EXAMPLES

Hereinafter, the present invention will be described in more detail by using Examples and Comparative Examples. The present invention is not limited at all by the following Examples as long as it does not exceed the gist of the present invention. Note that in the following Examples, the expression "parts" is on a mass basis unless otherwise indicated.

Example 1

An aluminum cylinder having a size of a diameter of 30 mm, a length of 357.5 mm, and a wall thickness of 1 mm was used as a support (conductive support).

Next, 100 parts of zinc oxide particles (specific surface area: 19 $m^2/g$, powder resistance: $4.7\times10^6$ Ω·cm) and 500 parts of toluene were stirred and mixed, into the resultant mixture, 0.8 part of a silane coupling agent was added, and the mixture was stirred for 6 hours. After that, the toluene was distilled off under reduced pressure, and the resultant mixture was heat-dried at 130° C. for 6 hours to obtain surface-treated zinc oxide particles. As the silane coupling agent, KBM602 (compound name: N-2-(aminoethyl)-3-aminopropylmethyldimethoxysilane) manufactured by Shin-Etsu Chemical Co., Ltd. was used.

Next, as a polyol resin, 15 parts of polyvinyl butyral resin (weight average molecular weight: 40000, trade name: BM-1, manufactured by SEKISUI CHEMICAL CO., LTD.) was prepared. Further, 15 parts of a blocked isocyanate (trade name: SUMIDUR 3175, manufactured by Sumika Covestro Urethane Co., Ltd. (former: Sumika Bayer Urethane Co., Ltd.) was prepared. These prepared materials were dissolved in 73.5 parts of methyl ethyl ketone and 73.5 parts of 1-butanol. Into the resultant mixture, 80.8 parts of the above-described surface-treated zinc oxide particles, and 0.8 part of 2,3,4-trihydroxybenzophenone (manufactured by TOKYO CHEMICAL INDUSTRY CO., LTD.) were added, and the mixture was dispersed for 3 hours under an atmosphere of 23±3° C. by a sand mill apparatus using glass beads each having a diameter of 0.8 mm. After the dispersion, into the resultant dispersion, 0.01 part of a silicone oil (trade name: SH28PA, manufactured by Dow Corning Toray Co., Ltd.) and 5.6 parts of crosslinked polymethyl methacrylate (PMMA) particles (trade name: TECHPOLYMER SSX-103, manufactured by Sekisui Plastics Co., Ltd., average primary particle diameter: 3 μm) were added and stirred, and a coating liquid for an undercoat layer was prepared.

The coating liquid for an undercoat layer was dip-coated on the above-described aluminum cylinder to form a coating film, the obtained coating film was dried at 160° C. for 40 minutes, and an undercoat layer having a film thickness of 18 μm was formed.

Next, hydroxygallium phthalocyanine crystal in a crystal form, which has strong peaks at Bragg angles 2θ±0.2° of 7.4° and 28.2° in CuKα characteristic X-ray diffraction, was prepared. The hydroxygallium phthalocyanine crystal in an amount of 20 parts, 0.2 part of a compound represented by the following formula (A), 10 parts of a polyvinyl butyral resin (trade name: S-LEC BX-1, manufactured by SEKISUI CHEMICAL CO., LTD.), and 600 parts of cyclohexanone were mixed. The mixture was dispersed for 4 hours in a sand mill apparatus using glass beads each having a diameter of 1 mm. After that, into the resultant mixture, 700 parts of ethyl acetate was added to prepare a coating liquid for a charge generating layer. This coating liquid for a charge generating layer was dip-coated on the above-formed undercoat layer to form a coating film, and the obtained coating film was heat-dried in an oven at a temperature of 80° C. for 15 minutes, and a charge generating layer having a film thickness of 0.17 μm was formed.

(A)

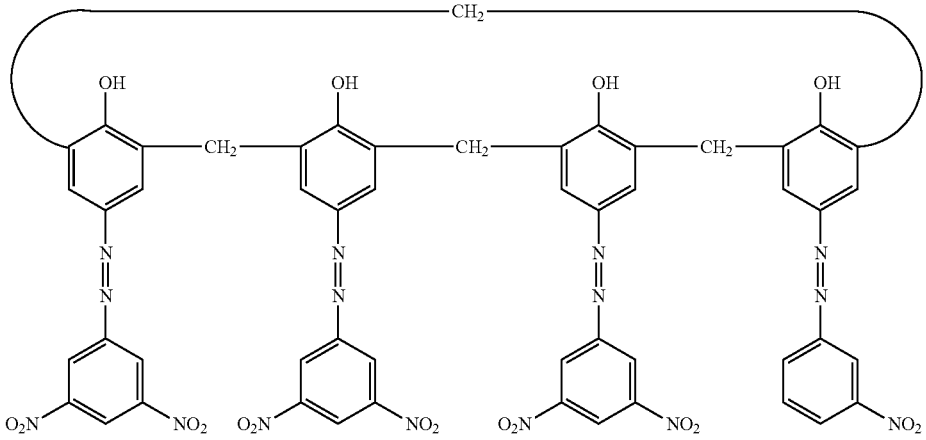

Next, as the charge transport material, 30 parts of a compound represented by the following formula (B), 60 parts of a compound represented by the following formula (C), and 10 parts of a compound represented by the following formula (D) were prepared. In addition, 100 parts of a polycarbonate resin (trade name: IUPILON Z400 bisphenol Z type, manufactured by Mitsubishi Engineering-Plastics Corporation) was prepared. Further, 0.02 part of polycarbonate (viscosity average molecular weight Mv: 20000) having a structural unit represented by the following formula (E) was prepared. These prepared materials were dissolved in a solvent of 600 parts of mixed xylene and 200 parts of dimethoxymethane, and a coating liquid for a charge transport layer was prepared. This coating liquid for a charge transport layer was dip-coated on the above-formed charge generating layer to form a coating film, and the obtained coating film was dried at 100° C. for 30 minutes, and a charge transport layer having a film thickness of 18 μm was formed.

(B)

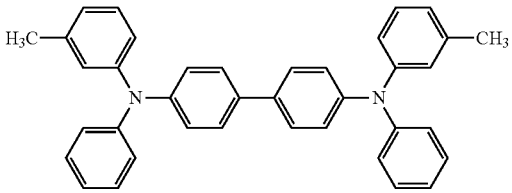

(C)

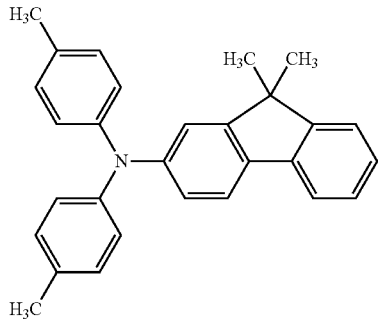

(D)

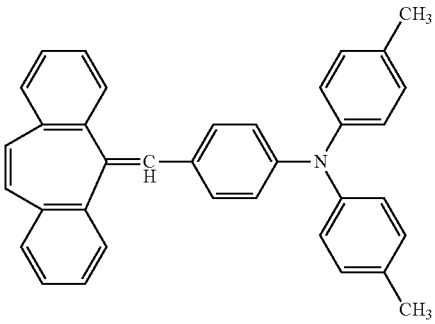

-continued (E)

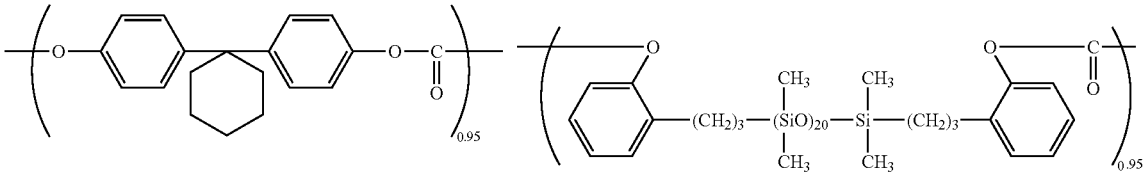

(In the formula (E), 0.95 and 0.05 are mole ratios (copolymerization ratios) of two of the structural units, respectively.)

Next, 14 parts of the above-described exemplary compound (No. 3) and 56 parts of a hole transport compound represented by the following formula (F) were prepared. In addition, 30 parts of polytetrafluoroethylene particles (Lubron L-2, manufactured by DAIKIN INDUSTRIES, LTD) and 1.5 parts of a fluorine atom-containing resin (trade name: GF300, manufactured by TOAGOSEI CO., LTD.) were prepared. These prepared materials were mixed with 100 parts of 1-propanol and 100 parts of 1,1,2,2,3,3,4-heptafluorocyclopentane (trade name: ZEORORAH, manufactured by ZEON CORPORATION), and then the resultant mixture was subjected to dispersion treatment with an ultra-high-speed disperser. After that, the mixture was filtered with a polyflon filter (trade name: PF-060, manufactured by Advantec Toyo Kaisha, Ltd.), and a coating liquid for a surface layer was prepared.

(F)

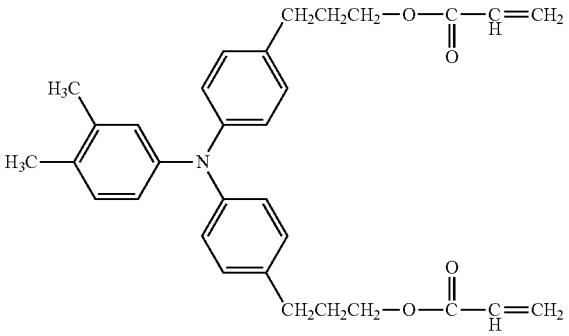

This coating liquid for a surface layer was dip-coated on the above-formed charge transport layer to form a coating film. The obtained coating film was dried at 50° C. for 5 minutes. Next, under a nitrogen atmosphere, the coating film was irradiated with electron beams for 1.5 seconds while rotating the support (object to be irradiated) at a speed of 200 rpm under the conditions of an acceleration voltage of 70 kV and a beam current of 5.0 mA. After that, the coating film was cured by raising the temperature of the coating film from 25° C. up to 140° C. over 15 seconds. In addition, the absorbed dose of the electron beam was 15 kGy as measured at this moment, and the oxygen concentration from the electron beam irradiation to the subsequent heat treatment was 16 ppm or less. Next, in the atmospheric air, the coating film was naturally cooled until the temperature of the coating film reached 25° C., and then was subjected to heat treatment at 100° C. for 15 minutes to form a surface layer (protection layer) having a film thickness of 5 μm.

In this way, an electrophotographic photosensitive member before formation of a concave portion, which had a protection layer, was prepared.

Next, a mold member (mold) was arranged in a pressure pattern transferring apparatus, and the surface processing was performed on the prepared electrophotographic photosensitive member before formation of a concave portion.

Figure 4A:
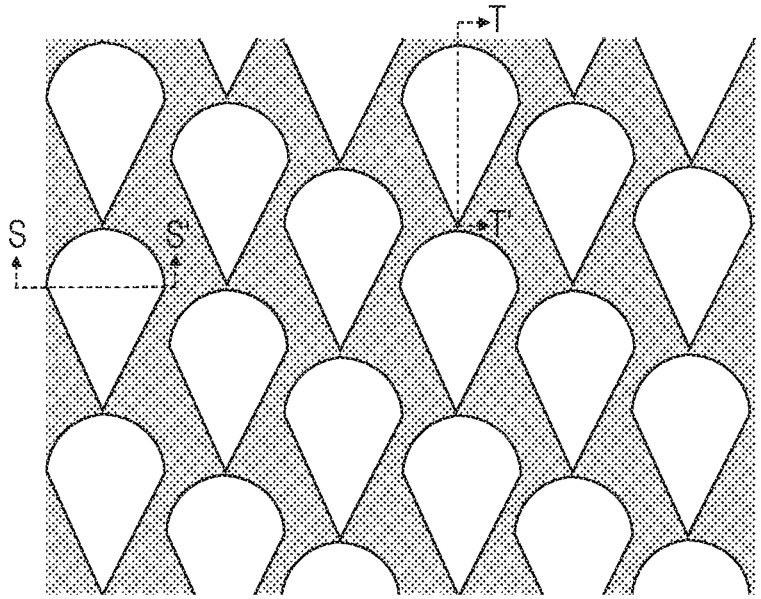
FIG. 4A is a top view illustrating a mold used in Examples and Comparative Examples according to the present invention.
Figure 4B:
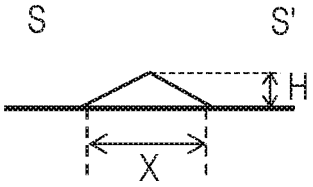
FIG. 4B is a sectional view illustrating a mold used in Examples and Comparative Examples according to the present invention.
Figure 4C:
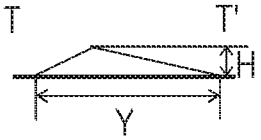
FIG. 4C is a sectional view illustrating a mold used in Examples and Comparative Examples according to the present invention.

Specifically, a mold illustrated in FIGS. 4A, 4B and 4C was arranged in a pressure pattern transferring apparatus having the configuration roughly illustrated in FIG. 3, and the surface processing was performed on the prepared electrophotographic photosensitive member before formation of a concave shape part. FIGS. 4A, 4B and 4C each are a diagram illustrating a mold used in Examples and Comparative Examples, and FIG. 4A is a top view illustrating an outline of the mold. In addition, FIG. 4B is a schematic sectional view (sectional view taken along the line S-S' in FIG. 4A) of a convex part of the mold in a shaft direction of the electrophotographic photosensitive member. Further, FIG. 4C is a sectional view (sectional view taken along the line T-T' in FIG. 4A) of a convex part of the mold in a circumferential direction of the electrophotographic photosensitive member. The mold illustrated in FIGS. 4A, 4B and 4C has a convex shape with a maximum width X of 50 μm, a maximum length Y of 75 μm, an area ratio of 56%, and a height H of 4 μm. Herein, the maximum width refers to a maximum width in a shaft direction of an electrophotographic photosensitive member of the convex part on the mold as viewed from above, and the maximum length refers to a maximum length in a circumferential direction of an electrophotographic photosensitive member of the convex part on the mold as viewed from above. Further, the area ratio refers to a ratio of the area of the convex parts to the area of the entire surface of the mold as viewed from above. During processing, the temperatures of the electrophotographic photosensitive member and the mold were controlled so that the temperature of the surface of the electrophotographic photosensitive member became 120° C. In addition, the electrophotographic photosensitive member was rotated in a circumferential direction while the electrophotographic photosensitive member and the pressure member were pressed against the mold under a pressure of 7.0 MPa, and concave shape parts were formed on the entire surface of a surface layer (circumferential surface) of the electrophotographic photosensitive member. In this way, the electrophotographic photosensitive member was produced.

The surface of the obtained electrophotographic photosensitive member was observed under magnification using a 50-power lens with a laser microscope (product name: X-100, manufactured by KEYENCE CORPORATION), and the concave shape part arranged on the surface of the electrophotographic photosensitive member was observed. During the observation, adjustment was made so that there was no tilt in a longitudinal direction of the electrophotographic photosensitive member, and in a circumferential direction, the laser microscope was adjusted so as to come into focus on the apex of the arc of the electrophotographic photosensitive member. Images obtained by observing under magnification were connected by an image connection application, and an area of a square 500 μm on a side was obtained. Further, for the obtained results, image processing height data were selected by the attached image analysis software, and filter processing was performed with a filter type median.

As a result of the above observation, the depth of the concave shape part was 2 μm, the width of the opening part in a shaft direction was 50 μm, the length of the opening part in a circumferential direction was 75 μm, and the area was 140000 $\mu m^2$. In this regard, the area refers to an area of the concave shape part on a surface of the electrophotographic photosensitive member as viewed from above, and means an area of the opening part of the concave shape part.

Examples 2 to 15

The electrophotographic photosensitive member was produced in a similar manner as in Example 1 except that the exemplary compound (No. 3) used for the preparation of a coating liquid for a surface layer in Example 1 was changed to the exemplary compounds each shown in Table 1.

Example 16

The electrophotographic photosensitive member was produced in a similar manner as in Example 1 except that the hole transport compound represented by the above-described formula (F), which had been used for the preparation of a coating liquid for a surface layer in Example 1, was changed to the hole transport compound represented by the following formula (G).

(G)

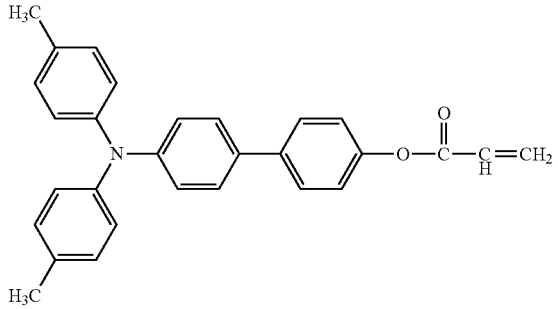

Example 17

The electrophotographic photosensitive member was produced in a similar manner as in Example 16 except that the exemplary compound (No. 3) used for the preparation of a coating liquid for a surface layer in Example 16 was changed to the exemplary compound (No. 22).

Example 18

The electrophotographic photosensitive member was produced in a similar manner as in Example 1 except that 0.5 part of a siloxane-modified acrylic compound (BYK-3550, manufactured by BYK Japan KK) was added to a coating liquid for a surface layer.

Example 19

The electrophotographic photosensitive member was produced in a similar manner as in Example 18 except that the exemplary compound (No. 3) used for the preparation of a coating liquid for a surface layer in Example 18 was changed to the exemplary compound (No. 9).

Comparative Example 1

The exemplary compound (No. 3) used for the preparation of a coating liquid for a surface layer in Example 1 was changed to the exemplary compound represented by the following formula (C-1), and the hole transport compound represented by the above-described formula (F) was changed to the hole transport compound represented by the following formula (H). Except for the changes described above, the electrophotographic photosensitive member was produced in a similar manner as in Example 1.

(C-1)

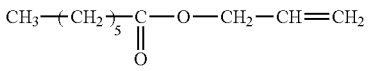

(H)

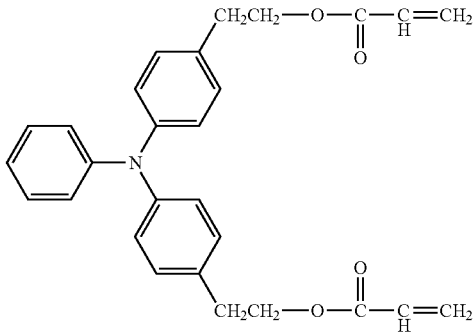

Comparative Example 2

The electrophotographic photosensitive member was produced in a similar manner as in Comparative Example 1 except that the compound represented by the above-described formula (C-1), which had been used for the preparation of a coating liquid for a surface layer in Comparative Example 1, was changed to the compound represented by the following formula (C-2).

(C-2)

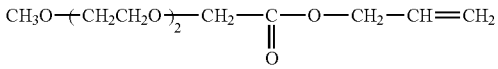

Comparative Example 3

The electrophotographic photosensitive member was produced in a similar manner as in Comparative Example 1 except that the compound represented by the above-described formula (C-1), which had been used for the preparation of a coating liquid for a surface layer in Comparative Example 1, was changed to the compound represented by the following formula (C-3).

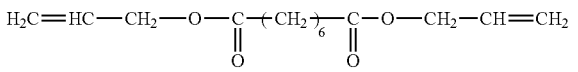

(C-3)

Comparative Example 4

The electrophotographic photosensitive member was produced in a similar manner as in Comparative Example 1 except that the compound represented by the above-described formula (C-1), which had been used for the preparation of a coating liquid for a surface layer in Comparative Example 1, was changed to the compound represented by the following formula (C-4).

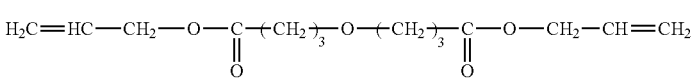

(C-4)

Comparative Example 5

The electrophotographic photosensitive member was produced in a similar manner as in Comparative Example 1 except that the compound represented by the above-described formula (C-1), which had been used for the preparation of a coating liquid for a surface layer in Comparative Example 1, was changed to the compound represented by the following formula (C-5).

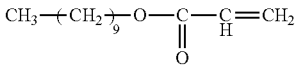

(C-5)

Comparative Example 6

The electrophotographic photosensitive member was produced in a similar manner as in Comparative Example 1 except that the compound represented by the above-described formula (C-1), which had been used for the preparation of a coating liquid for a surface layer in Comparative Example 1, was not used.

Comparative Example 7

The electrophotographic photosensitive member was produced in a similar manner as in Example 1 except that the hole transport compound (F), which had been used for the preparation of a coating liquid for a surface layer in Example 1, was not used.

[Evaluation]

The obtained electrophotographic photosensitive member was mounted on a cyan station of a modified machine of an electrophotographic apparatus (copying machine, trade name: iR-ADV C5255) manufactured by Canon Inc., which was an evaluation apparatus, and the image evaluation and the electric characteristics evaluations were performed in an environment of 30° C. and 80% RH under the conditions shown below.

<Evaluation for Image Streaks>

First, the total amount of discharge current in a charging process was set to be 70 μA and a cassette heater (drum heater) in the apparatus was turned off. After that, images on 50,000 sheets were continuously formed by using a test chart with an image ratio of 1%. After completion of the image formation, the power supply to the copying machine was stopped, and the copying machine was left to stand for 3 days. After the copying machine was left to stand for 3 days, the power supply to the copying machine was started again, and a half-tone image was output on an A4 horizontal size paper sheet.

The half-tone image obtained after the continuous formation of images on 50,000 sheets was evaluated as follows. In the present invention, it was determined that in Ranks A to C, the effect of suppressing the image streaks was sufficiently obtained, and in Ranks D and E, the effect of suppressing the image streaks was not sufficiently obtained.

Rank A: no vertical streak is observed.

Rank B: a minor vertical streak is generated only at one point on the image.

Rank C: minor vertical streaks are generated at several points on the image.

Rank D: clear vertical streaks are generated at several points on the image.

Rank E: clear vertical streaks are generated over the entire surface of the image.

<Electric Characteristics Evaluation>

Under the same conditions, images on 10,000 sheets were continuously formed by using a test chart with an image ratio of 1%, and the fluctuations in electrical potential of the electrophotographic photosensitive member was examined. The value of "potential after 10,000 sheets—initial potential" of the image exposure part VL was calculated as ΔVL. In the present invention, when the ΔVL was less than 20 V, it was determined that there was no problem in the electric characteristics of the electrophotographic photosensitive member.

The evaluation results of Examples 1 to 19 and Comparative Examples 1 to 7 are shown in Table 1.

TABLE 1

| | Hole transport compound | Compound represented by formula (1) | Rank of image streaks after passing 50,000 sheets | ΔVL (V) after passing 10,000 sheets |
|---|---|---|---|---|
| Example 1 | (F) | (No. 3) | B | 8 |
| Example 2 | (F) | (No. 9) | B | 8 |
| Example 3 | (F) | (No. 6) | B | 14 |
| Example 4 | (F) | (No. 12) | B | 15 |
| Example 5 | (F) | (No. 4) | B | 11 |
| Example 6 | (F) | (No. 5) | B | 12 |
| Example 7 | (F) | (No. 1) | C | 7 |
| Example 8 | (F) | (No. 2) | C | 8 |
| Example 9 | (F) | (No. 15) | B | 10 |
| Example 10 | (F) | (No. 20) | B | 11 |
| Example 11 | (F) | (No. 13) | C | 10 |
| Example 12 | (F) | (No. 19) | C | 10 |

TABLE 1-continued

| | Hole transport compound | Compound represented by formula (1) | Rank of image streaks after passing 50,000 sheets | ΔVL (V) after passing 10,000 sheets |
|---|---|---|---|---|
| Example 13 | (F) | (No. 16) | B | 14 |
| Example 14 | (F) | (No. 18) | B | 16 |
| Example 15 | (F) | (No. 22) | B | 13 |
| Example 16 | (G) | (No. 3) | B | 12 |
| Example 17 | (G) | (No. 22) | B | 15 |
| Example 18 | (F) | (No. 3) | A | 9 |
| Example 19 | (F) | (No. 9) | A | 8 |
| Comparative Example 1 | (H) | (C-1) | D | 8 |
| Comparative Example 2 | (H) | (C-2) | D | 7 |
| Comparative Example 3 | (H) | (C-3) | D | 9 |
| Comparative Example 4 | (H) | (C-4) | D | 9 |
| Comparative Example 5 | (H) | (C-5) | B | 41 |
| Comparative Example 6 | (H) | None | E | 7 |
| Comparative Example 7 | None | (No. 3) | B | 75 |

As a result of evaluation, in Examples, the effect of suppressing the image streaks in repeated use (after passing 50,000 sheets) was sufficiently obtained, and there was no problem also in the electric characteristics after passing 10,000 sheets.

In Comparative Examples 1 to 4, the effect of suppressing the image streaks in repeated use was not sufficiently obtained. In Comparative Example 5, there was a problem in the electric characteristics after passing 10,000 sheets. In Comparative Example 6, the effect of suppressing the image streaks in repeated use was not sufficiently obtained. In Comparative Example 7, there was a problem in the electric characteristics after passing 10,000 sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-186624, filed Sep. 27, 2017, which is hereby incorporated by reference herein in its entirety.

What is claimed is:

1. An electrophotographic photosensitive member, comprising:

an electroconductive support; a photosensitive layer; and a surface layer in this order, the surface layer being a cured product of a composition containing a hole transport compound having an acryloyloxy group or a methacryloyloxy group, and a compound represented by formula (1)

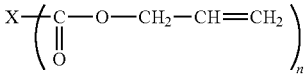

(1)

where n is an integer of 1 or more, and X is an n-valent group obtained by removing n pieces of hydrogen atoms from either an alkane having 7 or more carbon atoms or a compound having 7 or more carbon atoms represented by formula (2)

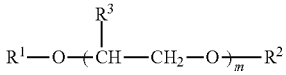

(2)

where m is an integer of 0 or more, $R^1$ and $R^2$ independently represent an alkyl group, and $R^3$ represents a hydrogen atom or a methyl group.

2. The electrophotographic photosensitive member according to claim 1, wherein X is an n-valent group obtained by removing n pieces of hydrogen atoms from an alkane having 7 to 19 carbon atoms or a compound having 7 to 19 carbon atoms represented by formula (2).

3. The electrophotographic photosensitive member according to claim 1, wherein X is an n-valent group obtained by removing n pieces of hydrogen atoms from either an alkane having 9 to 14 carbon atoms or a compound having 9 to 14 carbon atoms represented by formula (2).

4. The electrophotographic photosensitive member according to claim 1, wherein n is 1 or 2.

5. The electrophotographic photosensitive member according to claim 1, wherein n is 1.

6. The electrophotographic photosensitive member according to claim 1, wherein the hole transport compound is represented by formula (3)

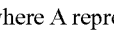

(3)

where A represents a hole transport group, $P^1$ is independently an acryloyloxy group or a methacryloyloxy group, and a is an integer of 2 to 4, and a hydrogen adduct in which a bonding site of A with $P^1$ is replaced with a hydrogen atom represented by formula (4) or formula (5)

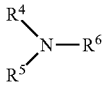

(4)

where $R^4$, $R^5$ and $R^6$ independently represent a phenyl group optionally having an alkyl group having 1 to 6 carbon atoms as a substituent; and

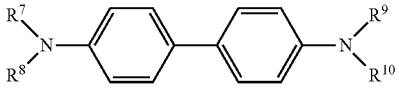

(5)

where $R^7$, $R^8$, $R^9$ and $R^{10}$ independently represent a phenyl group optionally having an alkyl group having 1 to 6 carbon atoms as a substituent.

7. The electrophotographic photosensitive member according to claim 1, wherein the composition further contains a siloxane-modified acrylic compound.

8. A method for producing an electrophotographic photosensitive member comprising an electroconductive support, a photosensitive layer and a surface layer in this order, the method comprising:

preparing a coating liquid containing a hole transport compound having an acryloyloxy group or a methacryloyloxy group, and a compound represented by formula (1)

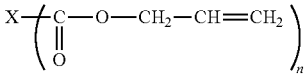

(1)

where n is an integer of 1 or more, and X is an n-valent group obtained by removing n pieces of hydrogen atoms from either an alkane having 7 or more carbon atoms or a compound having 7 or more carbon atoms represented by formula (2)

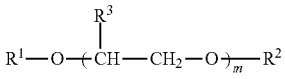

(2)

where m is an integer of 0 or more, $R^1$ and $R^2$ independently represent an alkyl group, and $R^3$ represents a hydrogen atom or a methyl group;

forming a coating film of the coating liquid on said photosensitive layer; and forming said surface layer of the electrophotographic photosensitive member by curing the coating film.

9. A process cartridge, comprising:

an electrophotographic photosensitive member having an electroconductive support, a photosensitive layer and a surface layer in this order; and at least one unit selected from the group consisting of a charging unit, a developing unit, a transferring unit, and a cleaning unit, the electrophotographic photosensitive member and the at least one unit being integrally supported, and the process cartridge being detachably attachable to a main body of an electrophotographic apparatus, wherein the surface layer is a cured product of a composition containing a hole transport compound having an acryloyloxy group or a methacryloyloxy group, and a compound represented by formula (1)

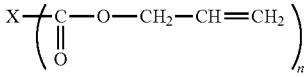

(1)

where n is an integer of 1 or more, and X is an n-valent group obtained by removing n pieces of hydrogen atoms from either an alkane having 7 or more carbon atoms or a compound having 7 or more carbon atoms represented by formula (2)

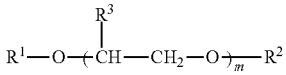

(2)

where m is an integer of 0 or more, $R^1$ and $R^2$ independently represent an alkyl group, and $R^3$ represents a hydrogen atom or a methyl group.

* * * * *